US006283180B1

(12) United States Patent
Chiang

(10) Patent No.: US 6,283,180 B1
(45) Date of Patent: Sep. 4, 2001

(54) WOOD PLANING MACHINE

(76) Inventor: Pei-Lieh Chiang, No. 12, Nan-Ping Rd., Nan Dist., Taichung City (TW)

( * ) Notice: Subject to any disclaimer, the term of this patent is extended or adjusted under 35 U.S.C. 154(b) by 0 days.

(21) Appl. No.: 09/709,675

(22) Filed: Nov. 9, 2000

(51) Int. Cl.[7] ..... B27C 1/00

(52) U.S. Cl. ..... 144/130; 33/642; 33/791; 83/522.19; 144/117.1; 144/373; 402/210

(58) Field of Search ..... 33/626, 640, 642, 33/700, 710, 791, 792; 83/522.11, 522.15, 522.19; 144/114.1, 117.1, 129, 130, 373; 409/210, 214, 218, 220; 451/9

(56) References Cited

U.S. PATENT DOCUMENTS 3,067,788 * 12/1962 Eschenburg ..... 144/129
3,718,168 * 2/1973 Berends ..... 144/129
5,795,113 * 8/1998 Wixey et al. ..... 83/522.19 X
5,927,357 * 7/1999 Welsh et al. ..... 144/130
5,957,174 * 9/1999 Shadeck ..... 144/130
6,131,628 * 10/2000 Chaing ..... 144/130

* cited by examiner

*Primary Examiner*—W. Donald Bray
(74) *Attorney, Agent, or Firm*—Christie, Parker & Hale, LLP

(57) ABSTRACT

A wood planing machine includes a base having posts and a seat mounted on the posts, a cutter carriage mounted on the posts, a rotary cutter mounted on the cutter carriage, a height adjusting unit for adjusting the height of the cutter carriage, and a height indicator including a lever having one end mounted on the seat and the other end projecting upwardly from the seat, a roller guide unit including a roller guide pivoted on the lever, and a flexible string passing through the roller guide. The string is secured to the cutter carriage at one end. The height indicator further includes an urging member interconnecting the work table and the other end of the string. The string has a reference segment that extends between the ends of the lever and that is exposed from the lever so that the moving distance of the reference segment can be measured with reference to the lever.

6 Claims, 7 Drawing Sheets

WOOD PLANING MACHINE

BACKGROUND OF THE INVENTION

1. Field of the Invention

This invention relates to a wood planing machine, more particularly to a wood planing machine having a cutter carriage with a height indicator above the cutter carriage for indicating working height of the cutter carriage.

2. Description of the Related art

FIG. 1 illustrates a conventional wood planing machine 10. The wood planing machine 10 includes a base 11 with upstanding posts 12 disposed at the corners of the base 11 for supporting a cutter carriage 13 thereon. A motor 14 is mounted on the cutter carriage 13 for driving a rotary cutter (not shown). The wood planing machine 10 is provided with a height adjusting unit (not shown) for adjusting height of the cutter carriage 13 via a handle-wheel 15 which is mounted on a top end of one of the posts 12. A scale 16 is attached to the aforesaid one of the posts 12 below the handle-wheel 15 for measuring the height of the cutter carriage 13.

The wood planing machine 10 is disadvantageous in that it is relatively inconvenient for an operator to view the scale 16 while operating the handle-wheel 15 to adjust the height of the cutter carriage 13, and that there is an undesirable need for an operator to bend his or her body in order to view to the scale

SUMMARY OF THE INVENTION

Therefore, it is an object of the present invention to provide a wood planing machine that is capable of overcoming the disadvantages described above.

Accordingly, a wood planing machine of this invention comprises: a base having a work table, a plurality of spaced apart posts that extend upright from the work table and that respectively have top end portions, and a seat mounted securely on the top end portion of at least one of the posts; a cutter carriage mounted on the posts above the work table and below the top ends of the posts, and movable along lengths of the posts; a rotary cutter mounted on the cutter carriage; a height adjusting unit for adjusting height of the cutter carriage relative to the work table; and a height indicator including a lever having one end mounted on the seat and the other end projecting upwardly from the seat, a roller guide unit including a roller guide pivoted on the other end of the lever, and a flexible string passing through the roller guide, and having two opposite ends extending downwardly from the roller guide, one of the opposite ends of the string being secured to the cutter carriage, the height indicator further including an urging member that has one end connected to the work table, and the other end connected to the other one of the opposite ends of the string for urging the string, the string being tensioned by the urging member, being movable along with the cutter carriage, and having a reference segment that extends between the opposite ends of the lever and that is exposed from the lever so that moving distance of the reference segment can be measured with reference to the lever.

BRIEF DESCRIPTION OF THE DRAWINGS

In drawings which illustrate an embodiment of the invention.

DETAILED DESCRIPTION OF THE PREFERRED EMBODIMENT

Figure 1:
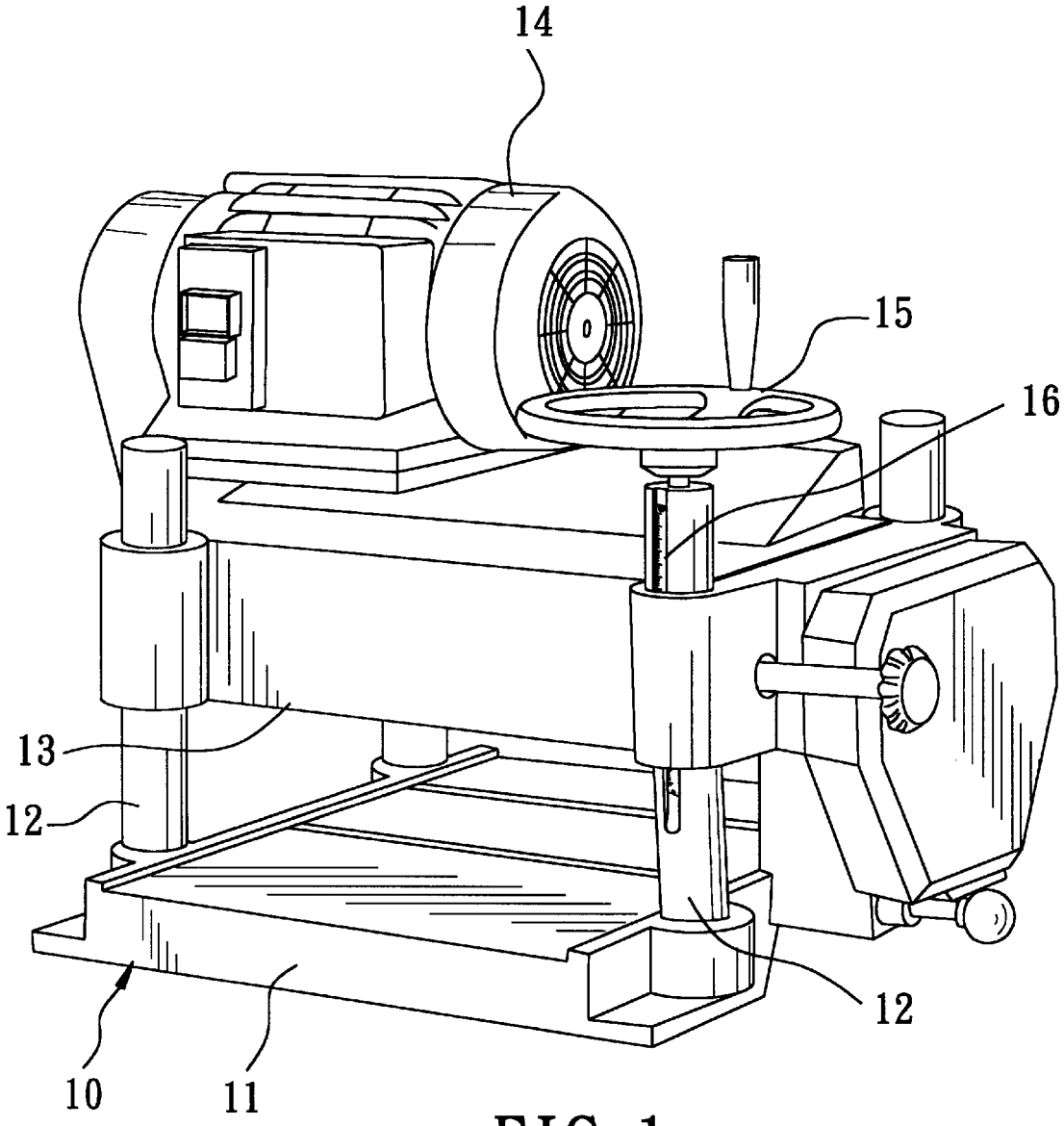
FIG. 1 PRIOR ART
FIG. 1 is a perspective view of a conventional wood planing machine.
Figure 2:
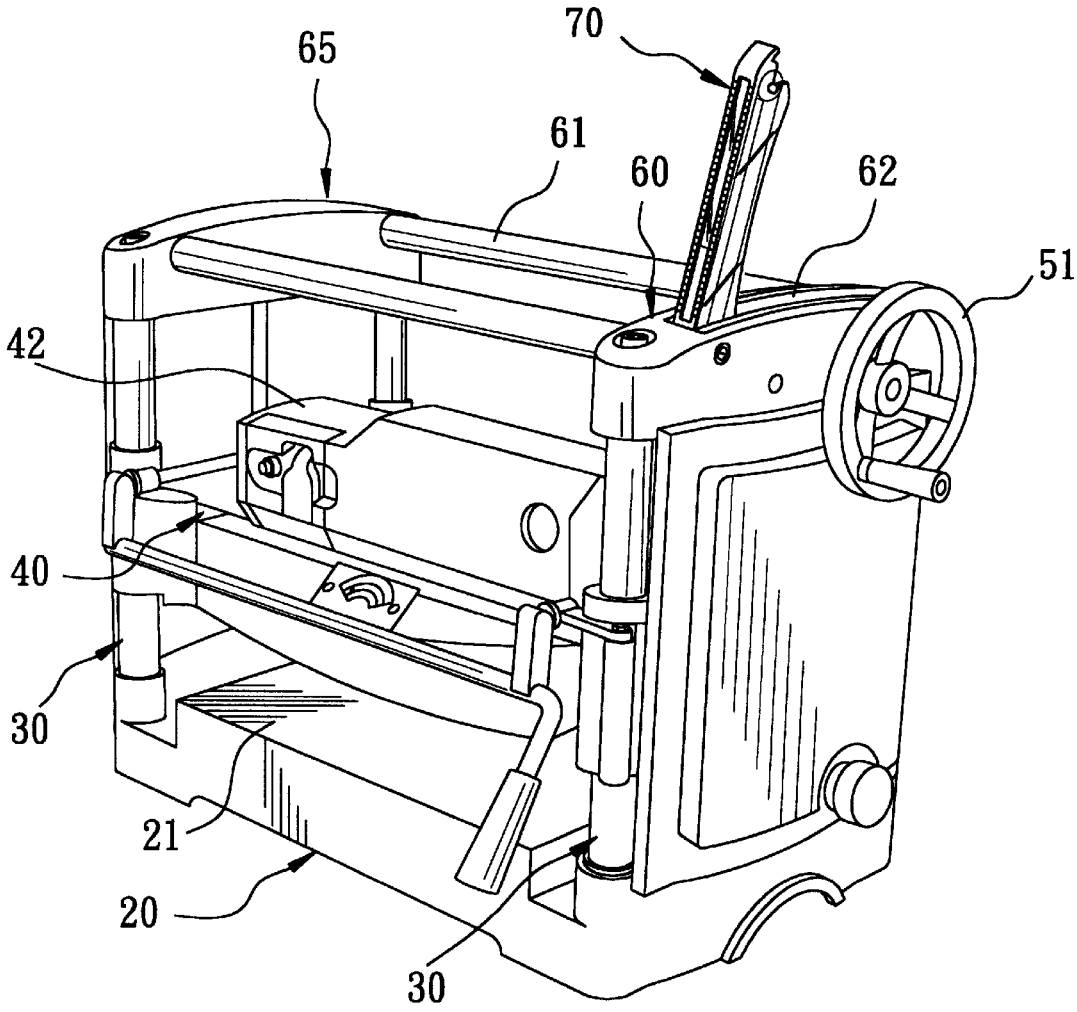
FIG. 2 is a perspective view of a wood planing machine embodying this invention.
Figure 3:
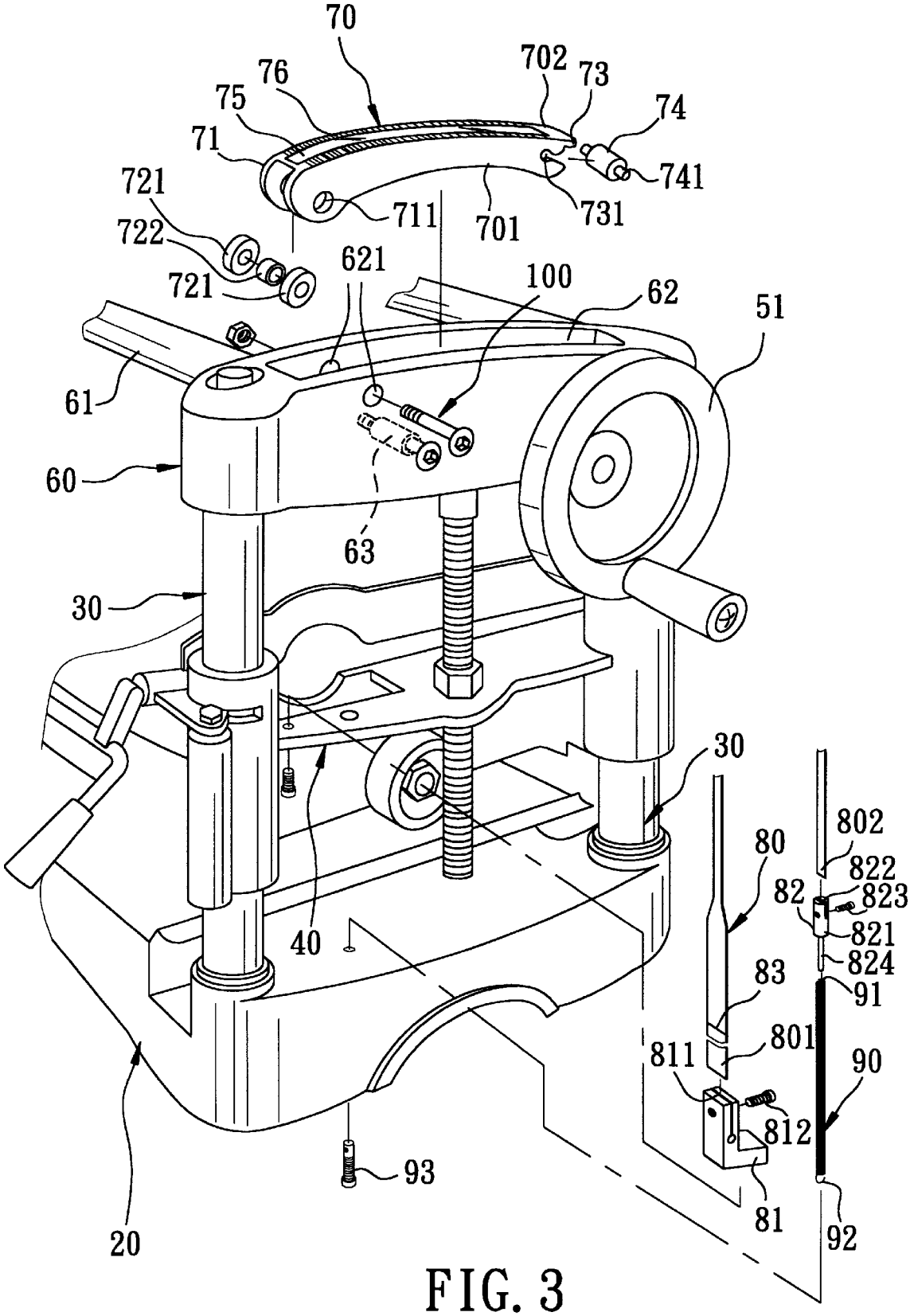
FIG. 3 is a partly exploded fragmentary view of the wood planing machine of FIG. 2.
Figure 4:
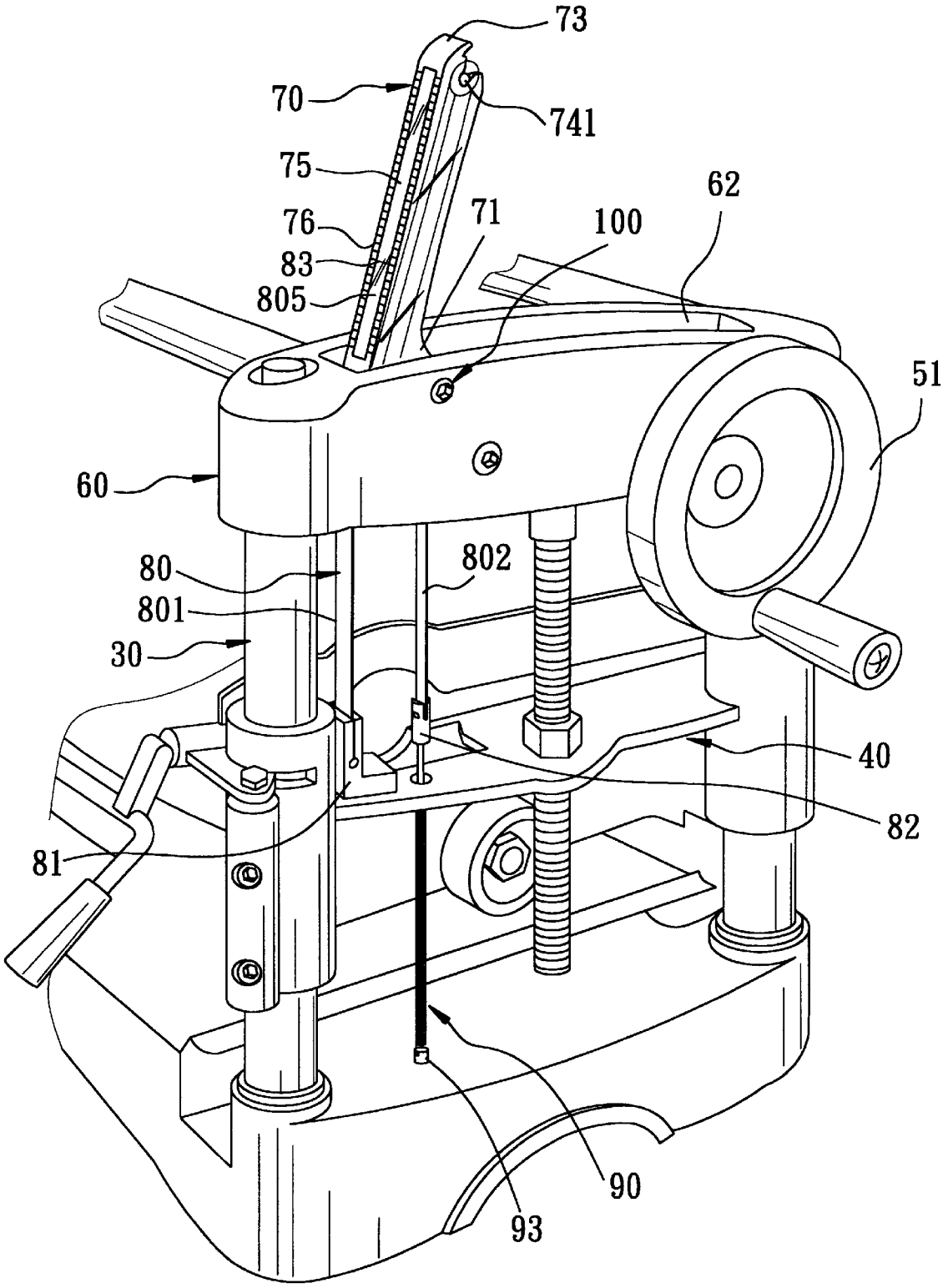
FIG. 4 is a fragmentary view of the wood planing machine of FIG. 2.
Figure 5:
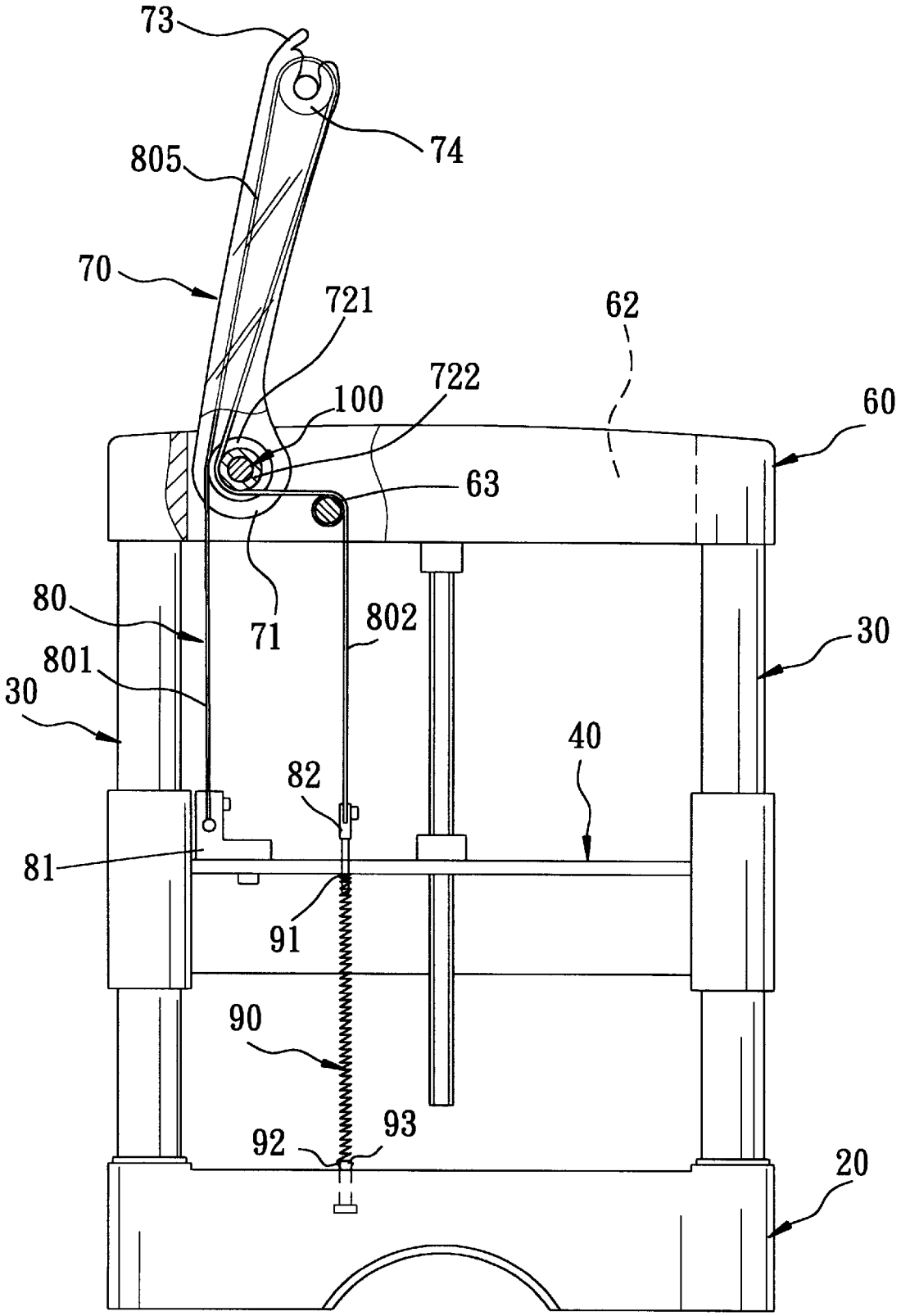
FIG. 5 is a side view to illustrate positions of the string and the coiled spring of the wood planing machine of FIG. 2.

FIGS. 2 to 5 illustrate a wood planing machine embodying this invention. The wood planing machine includes a base 20 having a work table 21 and four posts 30 raising uprightly from four corners of the work table 21, a cutter carriage 40 mounted movably on the posts 31, a motor-driven rotary cutter 42 mounted on the cutter carriage 40, opposite front and rear seats 60, 65 disposed at two opposite sides of the work table 21 and mounted on top end portions of the posts 30, a height adjusting unit (not shown) provided with a handle-wheel 51 for adjusting height of the cutter carriage 40, and a height indicator mounted on the front seat 60 adjacent to the handle-wheel 51.

Each of the front and rear seats 60, 65 spans and is mounted securely on two adjacent ones of the posts 30. A pair of rods 61, which are parallel to each other, interconnect the front and rear seats 60, 65. A slot 62 is formed in the front seat 60, and extends between the adjacent ones of the posts 30. A pair of pivot holes 621 are formed in the front seat 60 at two opposite sides of the slot 62 adjacent to one of the adjacent ones of the posts 30.

Figure 7:
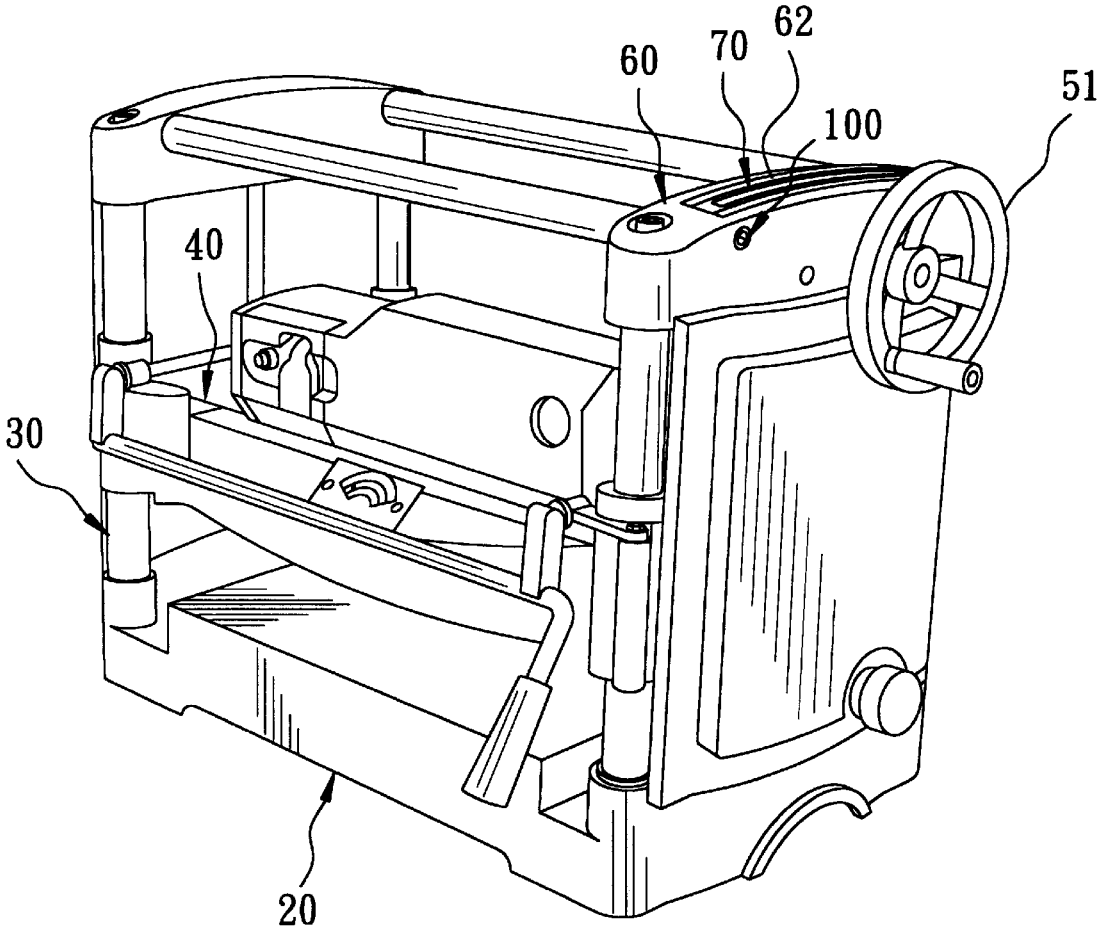
FIG. 7 is a perspective view to illustrate a ever received in a slot of a seat mounted on the wood planing machine of FIG. 2.

The height indicator includes a lever 70, a roller guide unit, an urging member 90 which is a coiled spring in this embodiment, and a flexible string 80. The lever 70 is configured as a hollow body, and has a peripheral wall 701 and an elongated opening 75 confined by the peripheral wall 701. A measuring scale 76 is marked on a top end face 702 of the peripheral wall 701. The lever 70 has one end 71 that is formed with a pair of pivot holes 711 and that is pivoted on the front seat 60 via a pivot pin 100 passing through the pivot holes 621, 711, and the other end 73 that is formed with a pair of pivot grooves 731. The lever 70 is turnable about the pivot pin 100 so that the lever 70 can be received in the slot 62 when the wood planing machine is not in operation (see FIG. 7), and so that the lever 70 can be raised upwardly from the slot 62 when the wood planing machine is in operation.

The roller guide unit includes a first roller guide 74 having two opposite studs 741 that pass through the opening 75 and that are mounted pivotally and respectively in the pivot grooves 731 in the other end 73 of the lever 70, spaced apart left and right roller guides 721 mounted pivotally on the pivot pin 100, a central roller guide 722 disposed between the left and right roller guides 721 and mounted pivotally on the pivot pin 100, and a second roller guide 63 mounted pivotally on the front seat 60 within the slot 62 at a position offset laterally from and parallel to the central roller guide 722. The central roller guide 722 has a diameter smaller than those of the left and right roller guides 721. The second roller guide 63 has a diameter substantially equal to that of the central roller guide 722. The width of the first roller guide 74 is sufficient enough to span the left and right roller guides 721.

The string 80 is configured as a flat sheet, and has a first section 801 that has a width spanning the left and right roller guides 721, and a second section 802 extending from the first section 801 and having a width substantially equal to that of the central roller guide 722. The first section 801 of the string 80 has one end secured to the cutter carriage 40 via a positioning plate 81, and extends upwardly therefrom to pass through the left and right roller guides 721 and through the first roller guide 74. The second section 802 of the string 80 extends downwardly from the other end of the first section 801, passes through the central roller guide 722 and through the second roller guide 63 to connect securely with one end 91 of the urging member 90 via a positioning rod 82. The other end 92 of the urging member 90 is secured to the work table via a positioning bolt 93. The positioning plate 81 has a top end formed with a slit 811 that receives the first section 801 of the string 80, which is clamped via screw means 812 passing through the slit 811 and the top end of the positioning plate 81. The positioning rod 82 has a top end formed with a slit 822 that receives the second section 802 of the string 80, which is clamped via screw means 823 passing through the slit 822 and the top end of the positioning rod 82. The end 91 of the urging member 90 is secured to a bottom pole 824 of the positioning rod 82. The string 80 is movable along with the cutter carriage 40, and is urged and is tensioned by the urging member 90 which is stretched via the string 80 when the cutter carriage 40 is moved downwardly along the lengths of the posts 30, and which is contracted to maintain the string 80 in the tensioned condition when the cutter carriage 40 is moved upwardly along the lengths of the posts 30.

Figure 6:
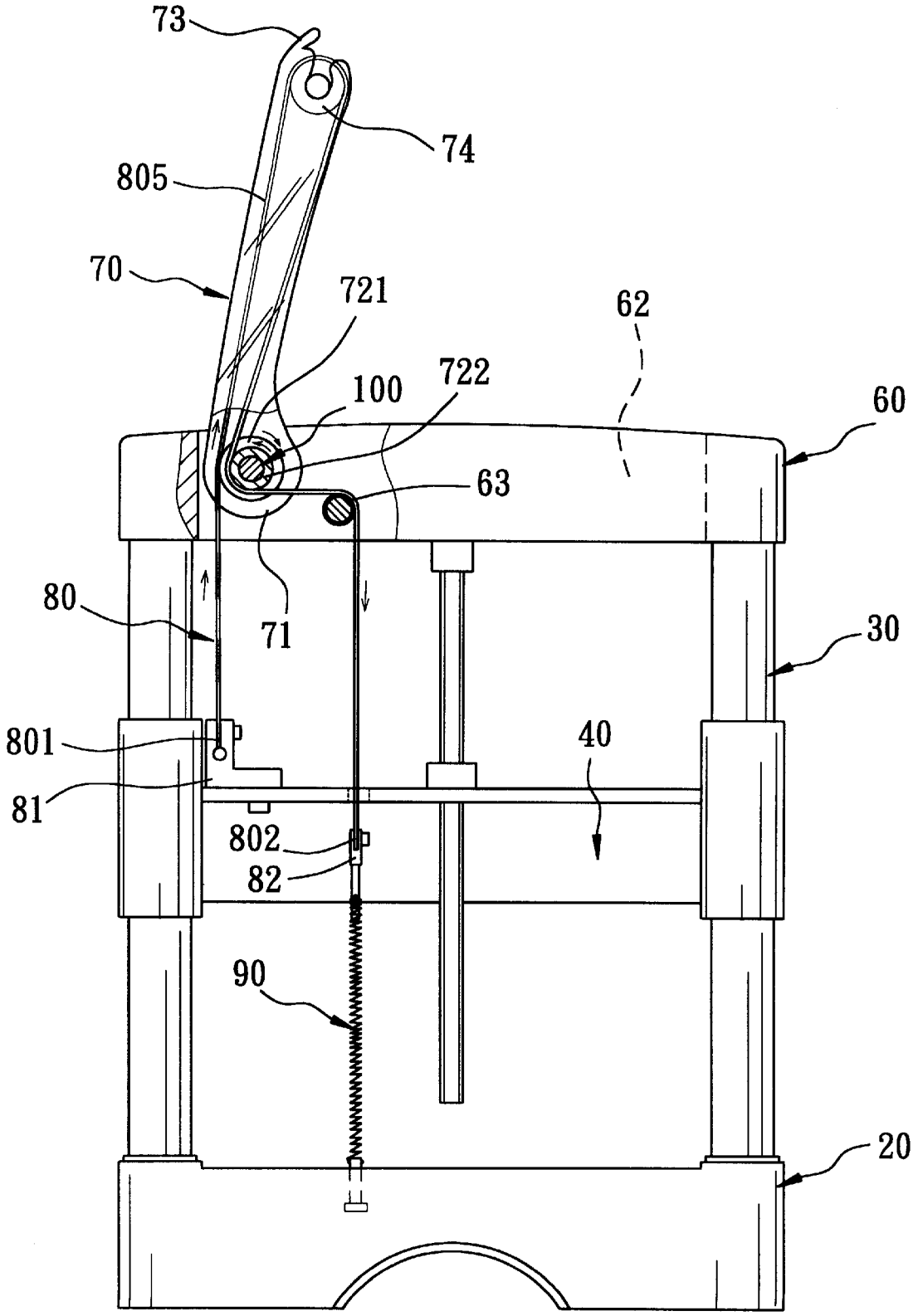
FIG. 6 is a side view to illustrate other positions of the string and the coiled spring of the wood planing machine of FIG. 2.

Referring now to FIG. 6, in combination with FIGS. 2 to 5, the first section 801 of the string 80 has a reference segment 805 extending between the ends 71, 73 of the lever 70 and exposed from the elongated opening 75 in the lever 70. The reference segment 805 has a reference line 83 marked thereon for referring to the measuring scale 76 of the lever 70 so that the moving distance of the reference segment 805 can be measured, and thus the height of the cutter carriage 40 can be instantaneously viewed while adjusting the height adjusting unit by operating the handle-wheel 51.

With the height indicator of this invention, the inconvenience encountered in the prior art can be eliminated.

With the invention thus explained, it is apparent that various modifications and variations can be made without departing from the spirit of the present invention. It is therefore intended that the invention be limited only as recited in the appended claims.

I claim:

1. A wood planing machine comprising:

a base having a work table, a plurality of spaced apart posts that extend upright from said work table and that respectively have top end portions, and a seat mounted securely on said top end portion of at least one of said posts;

a cutter carriage mounted on said posts above said work table and below said top ends of said posts, and movable along lengths of said posts;

a rotary cutter mounted on said cutter carriage;

a height adjusting unit for adjusting height of said cutter carriage relative to said work table; and a height indicator including a lever having one end mounted on said seat and the other end projecting upwardly from said seat, a roller guide unit including a first roller guide pivoted on said other end of said lever, and a flexible string passing through said first roller guide, and having two opposite ends extending downwardly from said first roller guide, one of said opposite ends of said string being secured to said cutter carriage, said height indicator further including an urging member that has one end connected to said work table, and the other end connected to the other one of said opposite ends of said string for urging said string, said string being tensioned by said urging member, being movable along with said cutter carriage, and having a reference segment that extends between said opposite ends of said lever and that is exposed from said lever so that moving distance of said reference segment can be measured reference to said lever.

2. The wood planing machine of claim 1, wherein said end of said lever is pivoted on said seat via a pivot pin, said roller guide unit further including spaced apart left and right roller guides mounted pivotally on said pivot pin, a central roller guide disposed between said left and right roller guides and mounted pivotally on said pivot pin, and a second roller guide mounted pivotally on said seat at a position offset from and parallel to said central roller guide, said central roller guide having a diameter smaller than those of said left and right roller guides, said string being configured as a flat sheet, and having a first section and a second section extending from said first section and having a width less than that of said first section, said first section of said string extending from said cutter carriage and passing through said left and right roller guides and said first roller guide, said second section of said string passing through said central roller guide and said second roller guide to connect with said other end of said urging member.

3. The wood planing machine of claim 2, wherein said seat spans and is mounted on two adjacent ones of said posts, and has a slot formed therein and extending between said adjacent ones of said posts for receiving said lever when said wood planing machine is not in operation.

4. The wood planing machine of claim 3, wherein said lever is configured as a hollow body, and has a peripheral wall and an elongated opening confined by said peripheral wall and exposing said reference segment of said string therefrom.

5. The wood planing machine of claim 1, wherein said urging member is a coiled spring.

6. The wood planing machine of claim 1, further comprising a handle-wheel disposed adjacent to said lever for driving said height adjusting unit to adjust the height of said cutter carriage.

* * * * *